US010688012B2

(12) United States Patent
Ritter

(10) Patent No.: US 10,688,012 B2
(45) **Date of Patent: *Jun. 23, 2020**

(54) SINGLE TUBE CRUTCH AND METHOD OF NESTING AND PACKAGING THE SAME

(71) Applicant: Medline Industries, Inc, Northfield, IL (US)

(72) Inventor: Joseph Ritter, Arlington Heights, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/058,904

(22) Filed: Aug. 8, 2018

(65) Prior Publication Data

US 2018/0344563 A1 Dec. 6, 2018

Related U.S. Application Data

(63) Continuation of application No. 15/214,834, filed on Jul. 20, 2016, now Pat. No. 10,137,051.

(51) Int. Cl.

| | |
|---|---|
| ***A61H 3/02*** | (2006.01) |
| ***B65D 71/08*** | (2006.01) |
| *B65D 85/62* | (2006.01) |

(52) U.S. Cl.

CPC ..... *A61H 3/02* (2013.01); *A61H 3/0244* (2013.01); *B65D 71/08* (2013.01); *A61H 2003/025* (2013.01); *A61H 2201/0161* (2013.01); *A61H 2201/0192* (2013.01); *A61H 2201/16* (2013.01); *B65D 85/62* (2013.01)

(58) Field of Classification Search

CPC ... A61H 3/02; A61H 3/0244; A61H 2003/025

See application file for complete search history.

(56) References Cited

U.S. PATENT DOCUMENTS

| | | | | |
|---|---|---|---|---|
| 1,400,394 A | | 12/1921 | Warry | |
| 2,398,247 A | | 4/1946 | Redcliffe | |
| 2,568,654 A | * | 9/1951 | Neptune | A61H 3/02 135/68 |

(Continued)

FOREIGN PATENT DOCUMENTS

| | | |
|---|---|---|
| CN | 202161528 | 3/2012 |
| CN | 203121297 | 8/2013 |

(Continued)

OTHER PUBLICATIONS

"Medline Catalog", Universal Single Tube Crutch; Medline Catalog; Unknown Publication Date but believed to be prior to filing or present application.

(Continued)

*Primary Examiner* — Noah Chandler Hawk

(74) *Attorney, Agent, or Firm* — Philip H. Burrus, IV

(57) ABSTRACT

A single-tube crutch (100) includes an upper leg (101) and a lower leg (301). The lower leg (301) can be fully insertable into a first end of the upper leg such that only a slip-resistant tip (102) is exposed. The single-tube crutch can include an underarm support (104) coupled to a second end of the upper leg opposite the first end. A grip assembly (105) translates along the upper leg between a usage position and a stowed position.

20 Claims, 9 Drawing Sheets

(56) References Cited

U.S. PATENT DOCUMENTS

| | | | | |
|---|---|---|---|---|
| 2,590,607 | A | 3/1952 | Grimball | |
| 2,736,330 | A | 2/1956 | Wood | |
| 3,133,551 | A | 5/1964 | Murcott | |
| 3,338,387 | A | 8/1967 | Ferry | |
| 3,417,765 | A | 12/1968 | Slater | |
| 3,635,233 | A | 1/1972 | Robertson | |
| 3,710,807 | A | 1/1973 | Ferry | |
| 4,385,697 | A | 5/1983 | Urban et al. | |
| 4,787,405 | A | 11/1988 | Karwoski | |
| 4,809,725 | A | 3/1989 | Champigny | |
| 4,846,203 | A | 7/1989 | Tappel | |
| 4,917,126 | A | 4/1990 | Ellmore | |
| 5,139,040 | A | 8/1992 | Kelly | |
| 5,193,567 | A | 3/1993 | Razny, Jr. | |
| 5,201,334 | A | 4/1993 | Tseng | |
| 5,482,070 | A | 1/1996 | Kelly | |
| 5,673,719 | A | 10/1997 | Shofner | |
| 6,085,766 | A | 7/2000 | Geary | |
| 6,561,206 | B1 | 5/2003 | Wilkinson | |
| D540,534 | S | 4/2007 | Chan et al. | |
| D552,245 | S | 10/2007 | Davis | |
| 7,451,775 | B1 * | 11/2008 | Werner, III | A45B 9/02 135/65 |
| 7,581,643 | B2 * | 9/2009 | Wilskey | B65D 33/105 206/278 |
| 7,610,926 | B2 | 11/2009 | Adams | |
| 7,735,500 | B2 | 6/2010 | Jacobs et al. | |
| D624,303 | S | 9/2010 | Jones | |
| D679,492 | S | 4/2013 | Pethoud | |
| D690,927 | S | 10/2013 | Jones | |
| D693,565 | S | 11/2013 | Chan | |
| 8,720,458 | B2 | 5/2014 | Dickerson, II | |
| 9,289,346 | B2 * | 3/2016 | Demski | A61H 3/02 |
| D761,549 | S | 7/2016 | Pepper | |
| 9,561,150 | B2 | 2/2017 | Dickerson, II | |
| D789,073 | S | 6/2017 | Wu | |
| 2004/0011393 | A1 | 1/2004 | Whitworth | |
| 2006/0289046 | A1 | 12/2006 | Cato | |
| 2010/0024857 | A1 | 2/2010 | Larson et al. | |
| 2010/0071739 | A1 * | 3/2010 | Cho | A61H 3/02 135/72 |

FOREIGN PATENT DOCUMENTS

| | | | |
|---|---|---|---|
| DE | 202016105727 U1 * | 11/2016 | A61H 3/02 |
| KR | 2004085849 | 10/2004 | |

OTHER PUBLICATIONS

Weeks, Benjamin , "Notice of Allowance", U.S. Appl. No. 29/571,624, filed Jul. 20, 2016; dated Jan. 22, 2018.

Weeks, Benjamin , "Non Final OA", U.S. Appl. No. 29/571,624, filed Jul. 20, 2016; dated Jul. 20, 2017.

Yip, Winnie , "NonFinal OA", U.S. Appl. No. 15/214,834, filed Jul. 20, 2016; dated Mar. 8, 2017.

Yip, Winnie , "Final OA", U.S. Appl. No. 15/214,834, filed Jul. 20, 2016; dated Sep. 1, 2017.

Yip, Winnie , "Non-Final OA", U.S. Appl. No. 15/214,834, filed Jul. 20, 2016; dated Feb. 28, 2018.

Yip, Winnie , "Notice of Allowance", U.S. Appl. No. 15/214,834, filed Jul. 20, 2016; dated Jul. 26, 2018.

* cited by examiner

SINGLE TUBE CRUTCH AND METHOD OF NESTING AND PACKAGING THE SAME

CROSS REFERENCE TO PRIOR APPLICATIONS

This application is a continuation application claiming priority and benefit under 35 U.S.C. § 120 from U.S. application Ser. No. 15/214,834, filed Jul. 20, 2016, which is incorporated by reference for all purposes.

BACKGROUND

Technical Field

This disclosure relates generally to crutches, and more particularly to single tube crutches.

Background Art

Crutches have been used for centuries during rehabilitation of injuries to hips and legs. For example, when a leg is broken or an ankle is sprained, a person may use one or two crutches while the leg or ankle heals. A person uses a crutch to reduce the amount of weight loading an injured body portion. A person also uses a crutch to increase stability and balance when a lower limb or connecting part is injured or otherwise not available for mobility.

Some factors used to select an appropriate crutch include crutch cost, crutch weight, crutch adjustability, crutch comfort, and crutch stability. While crutches have been used for a long time, and while some of the materials used to make crutches have become stronger and lighter, some crutches are too expensive. Others are too heavy. Illustrating by example, crutches employing two parallel bowed tubes can be so heavy that they reduce comfort and ease of use, especially when used by children or the elderly.

It would be advantageous to have an improved crutch.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
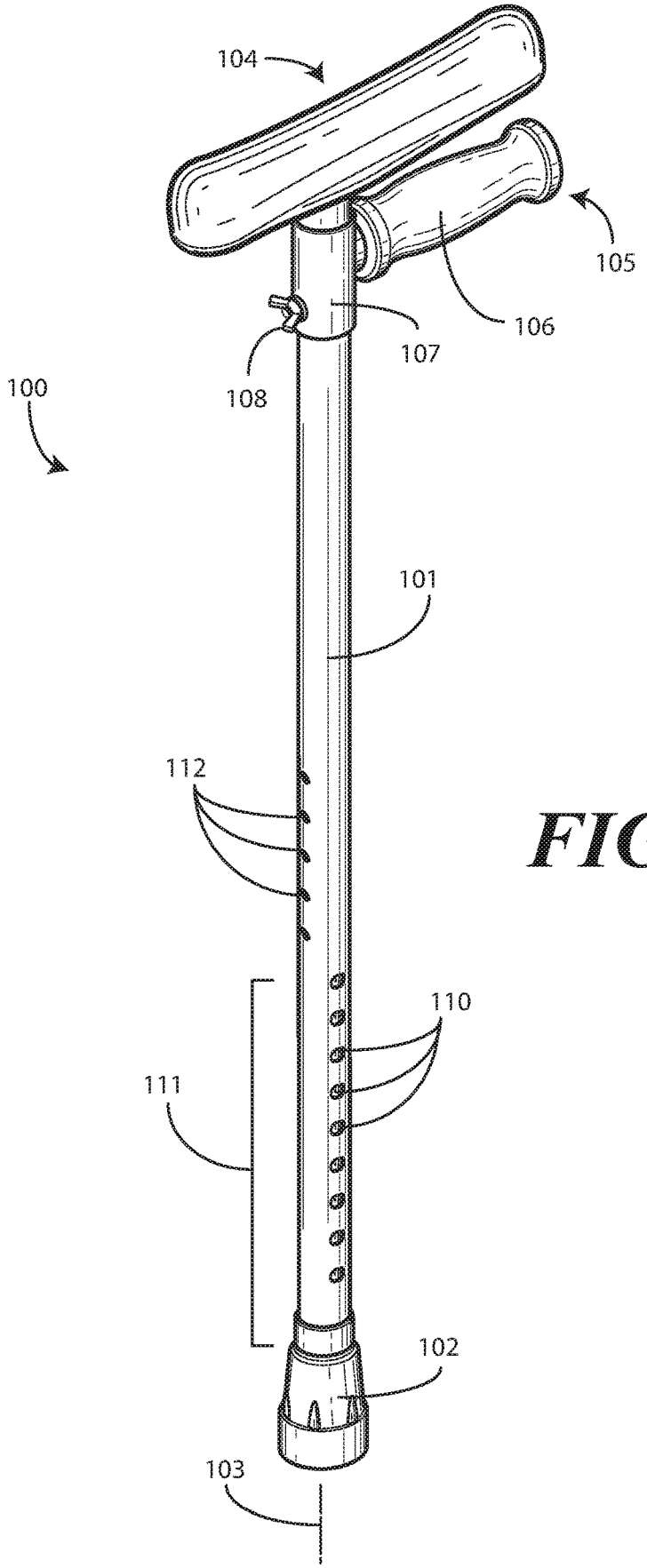
FIG. 1 illustrates a perspective view of one explanatory crutch in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" or "about" are used to refer to an alignment or measurement inclusive of manufacturing tolerances. Thus, an angle of "about ninety degrees," where the manufacturing tolerances were plus or minus two degrees would include angles of 88 to 92 degrees, inclusive. Also, reference designators shown herein in parenthesis indicate components shown in a figure other than the one in discussion. For example, talking about a device (10) while discussing figure A would refer to an element, 10, shown in figure other than figure A.

Embodiments of the disclosure contemplate that the marketplace for crutches has become increasingly commoditized. As a result, many companies and other purchasers of crutches have begun importing their own crutches employing two parallel bowed tubes that extend downwardly from an underarm support to a handle from overseas. However, as noted above, these crutches are frequently too heavy and two expensive. Advantageously, embodiments of the present disclosure provide a novel single-tube crutch design that can be manufactured inexpensively and that works to dramatically reduce the weight of the crutch without sacrificing the weight-bearing capacity of the crutch.

In one embodiment a crutch comprises a single tube support comprising an upper leg and a lower leg. The lower leg can optionally comprise a slip-resistant tip. In one embodiment, the lower leg is fully insertable into a first end of the upper leg such that only the slip-resistant tip is exposed. A grip assembly is then configured to translate along the upper leg between a usage position and a stowed position. In one embodiment where both the upper leg and the lower leg are manufactured from steel, embodiments of the disclosure advantageously offer a single tube crutch with increased weight-bearing capacity of seventeen percent over prior art crutches. At the same time, embodiments of the disclosure are between seven and nine percent cheaper to manufacture than are prior art crutches. The ability of the grip assembly to translate along the upper leg additionally enables an optimized shipping configuration.

Figure 2:
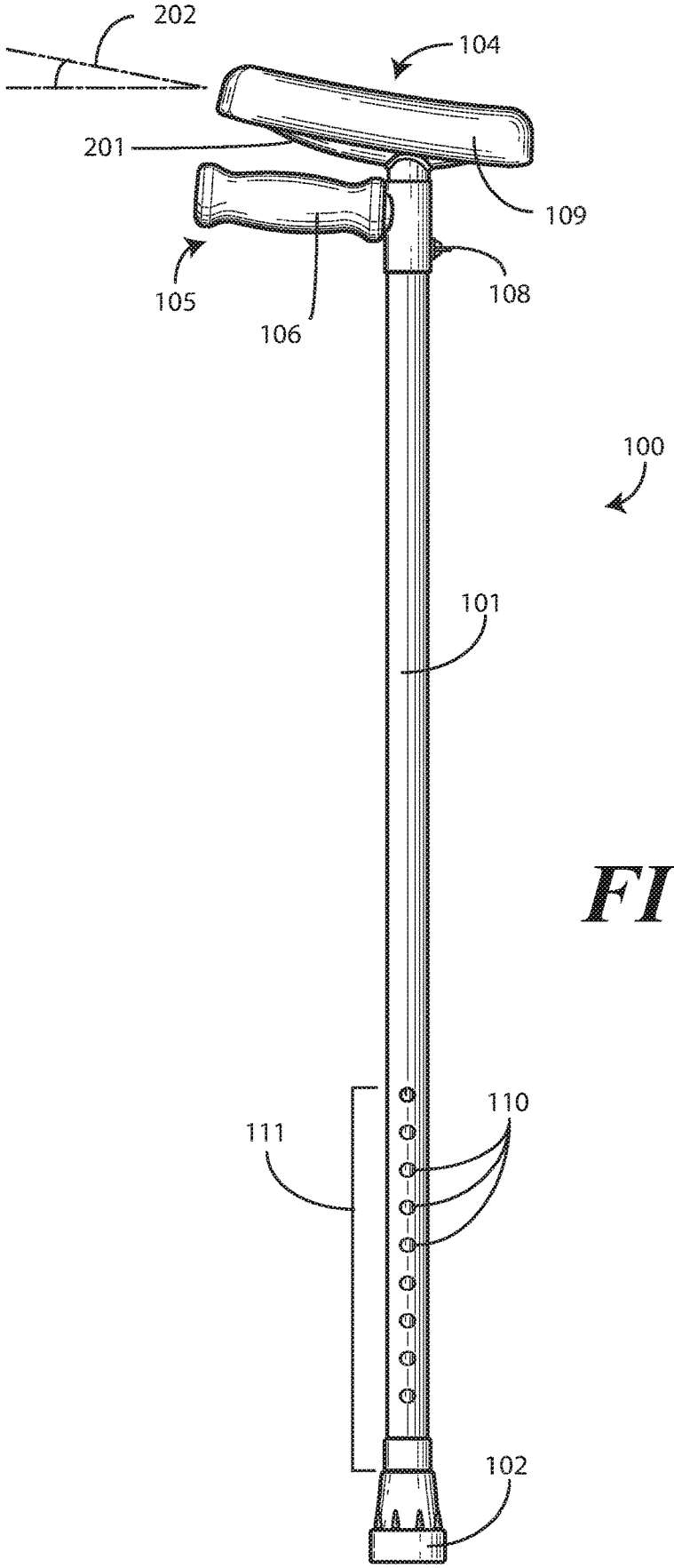
FIG. 2 illustrates a side elevation view of one explanatory crutch, in a collapsed configuration with a stowed grip, in accordance with one or more embodiments of the disclosure.
Figure 3:
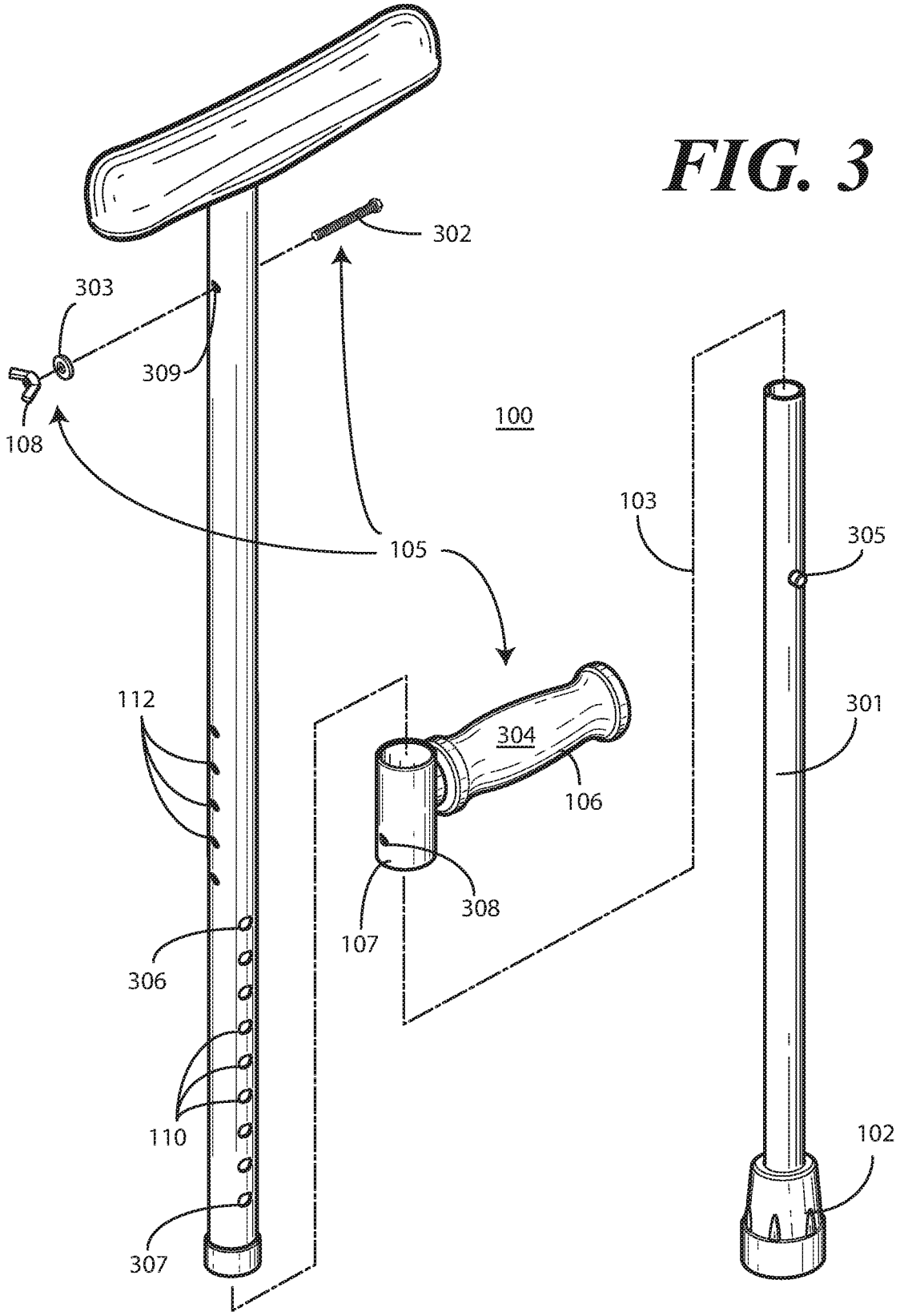
FIG. 3 illustrates an exploded view of one explanatory crutch in accordance with one or more embodiments of the disclosure.

Turning now to FIGS. 1-3, illustrated therein is one embodiment of a single-tube crutch 100 in accordance with one or more embodiments of the disclosure. In contrast to prior art crutches that include two parallel bowed tubes that extend downwardly from an underarm support, embodiments of the disclosure provide a single-tube crutch 100 includes a "single tube" comprising a substantially vertical, lower leg 301, which nests within, and can be extended from, a substantially vertical, upper leg 101. In this illustrative embodiment the lower leg 301 can be covered with a slip-resistant tip 102 configured to increase a friction coefficient between the single-tube crutch 100 and a floor, street, or the ground.

In one or more embodiments, the substantially vertical, lower leg 301 and the substantially vertical, upper leg 101 can each be manufactured from metal, wood, fiberglass, carbon fiber, aluminum, or other materials. Illustrating by example, in one embodiment the substantially vertical, lower leg 301 and the substantially vertical, upper leg 101 are manufactured from steel. The single-tube crutch 100 is generally designed, in comparison to other available crutches, to have a low cost and low weight, and, further, to provide improved convenience, comfort, and stability for the user.

Analysis confirms that crutches configured in accordance with embodiments of the disclosure advantageously to increase weight-bearing capacity by seventeen percent compared to prior art crutches. Additionally, embodiments of the disclosure reduce the cost of manufacture by seven to nine percent when compared to prior art designs. The single-tube crutch 100 provides a user with adequate support, having at least a 300-pound weight-bearing capacity. The single tube defined by the substantially vertical, lower leg 301 and the substantially vertical, upper leg 101 is the main weight-receiving member of the single-tube crutch 100.

In this illustrative embodiment, each of the substantially vertical, lower leg 301 and the substantially vertical, upper leg 101 are both disposed along a central axis 103. As will be described in more detail with reference to FIG. 4 below, in one embodiment the substantially vertical, lower leg 301 is a telescoping leg, in that it can extend downwardly along the central axis 103 from the substantially vertical, upper leg 101 to extend the overall length of the single-tube crutch 100.

In addition to the substantially vertical, lower leg 301 and the substantially vertical, upper leg 101, in one or more embodiments the single-tube crutch 100 also includes an underarm support 104 and a grip assembly 105. The grip assembly 105 comprises a grip 106 that extends distally from an annular receiver 107 that engages the substantially vertical, upper leg 101 as best shown in FIG. 3. In one embodiment the annular receiver 107 is configured as a cylinder having an inner diameter slightly larger than an outer diameter of the substantially vertical, upper leg 101 so as to slip about, and be able to translate along, the substantially vertical, upper leg 101 between an usage position and a stowed position as will be described in more detail below. In one or more embodiments, the grip assembly 105 also comprises a fastener, such as a screw 302, a complementary fastener, such as a wing nut 108, and an optional washer 303, which can be a locking washer in one or more embodiments.

A crutch user places the underarm support 104 under his or her underarm and grasps the grip 106 when using the single-tube crutch 100. Said differently, in one embodiment when the single-tube crutch 100 is in use, the underarm support 104 is placed between the user's upper arm and torso beneath the armpit.

In one or more embodiments, the annular receiver 107 is manufactured from the same material that the substantially vertical, lower leg 301 and the substantially vertical, upper leg 101. For example, in one embodiment where the substantially vertical, lower leg 301 and the substantially vertical, upper leg 101 are manufactured from steel, the annular receiver 107 can also be manufactured from steel. In other embodiments, the annular receiver 107 is manufactured from a different material than the substantially vertical, lower leg 301 and the substantially vertical, upper leg 101. For example, where the substantially vertical, lower leg 301 and the substantially vertical, upper leg 101 are manufactured from steel or aluminum, the annular receiver 107 can be manufactured from another material, such as aluminum, wood, rubber, acrylic, or other materials.

In one or more embodiments, the grip 106 comprises an extension extended from, and manufactured from the same material as, the annular receiver 107. For example, in one embodiment the grip 106 and the annular receiver 107 can be manufactured as a unitary part. In other embodiments, the grip 106 can be separable from the annular receiver 107 so that different grips can be attached to the annular receiver 107. Other ways of configuring the grip 106 and annular receiver 107 will be obvious to those of ordinary skill in the art having the benefit of this disclosure.

In one or more embodiments, a covering can be applied to the grip 106. For example, a rubber foam or sponge type coating can be applied to the grip 106 to make it softer and more comfortable for a user. Perspiration absorbing materials, antimicrobial materials, friction increasing materials, or other materials can be applied to the grip 106 as well.

In one embodiment, the grip 106 includes an outer covering member that is comprised of a textured rubber material that is strong and durable. Optionally, the grip 106 is water resistant. The rubber material can be, for example, a petroleum-based rubber or a foam rubber. The grip 106 can also include an inner member that can optionally be a hollow cylinder. The inner member may be comprised of plastic or any other type of material. In general, the inner member provides support and rigidity, and the outer rubber member provides a more comfortable feeling for the user. In one embodiment, the grip 106 is fitted for the size of a user's hand and is smaller than the underarm support 104.

In one embodiment, the grip 106 has an arcuate outer surface 304. As best shown in FIG. 3, the arcuate outer surface 304 is bow-shaped in one embodiment. In other embodiments, the grip 106 can have a differently shaped surface. For example, finger indentations could be molded into the grip 106. Similarly, shapes and contours could be molded into the grip 106 to accommodate a user's palm, heel of hand, or thumb. Other configurations of the outer surface of the grip 106 will be obvious to those of ordinary skill in the art having the benefit of this disclosure.

In one or more embodiments, the underarm support 104 is fixedly attached to a top end of the substantially vertical, upper leg 101. As best shown in FIG. 2, in one embodiment the underarm support 104 includes an ergonomically curved tube 201 that is contoured in a convex down configuration to receive a user's underarm in the convex portion of the ergonomically curved tube 201. As with the grip 106, the underarm support can include a covering 109. The covering 109 can be a rubber foam or sponge type coating can be applied to the ergonomically curved tube 201 to make it softer and more comfortable for a user. Perspiration absorbing materials, antimicrobial materials, friction increasing materials, or other materials can be applied to the covering 109 as well. In this illustrative embodiment, the covering 109 stretches across the top of the ergonomically curved tube 201 to define a line 202 that defines an obtuse angle with the substantially vertical, upper leg 101. In other embodiments, the covering 109 can stretch arcos the top of the ergonomically curved tube 201 to define a line that is substantially orthogonal with the substantially vertical, upper leg 101. Other configurations will be obvious to those of ordinary skill in the art having the benefit of this disclosure.

In one or more embodiments, the ergonomically curved tube 201 is fixedly attached to the top end of the substantially vertical, upper leg 101. However, in other embodiments the ergonomically curved tube 201 is adjustable relative to the substantially vertical, upper leg 101.

The extension of the substantially vertical, lower leg 301 relative to the substantially vertical, upper leg 101, in one embodiment, can be adjusted via a plurality of leg extension apertures 110. Note that while one set of leg extension apertures is shown in FIG. 3, for example, a complementary set of leg extension apertures is shown on the opposite side of the single-tube crutch 100 as can be seen comparing, e.g., FIG. 1 with FIG. 3. The plurality of leg extension apertures 110 are located along the lower portion 111 of the substantially vertical, upper leg 101 in this embodiment. This illustrative embodiment includes nine apertures in the plurality of leg extension apertures 110.

In this illustrative embodiment, the substantially vertical, lower leg 301 includes a push button 305 on each side that is spring biased outwardly from the substantially vertical, lower leg 301. One push button 305 is shown in FIG. 3, while another is shown in the uppermost leg insertion aperture of FIG. 2. Any other mechanism can be used in addition to or instead of a push button 305. For example, instead of the push button 305, a pin or a clip can also be used. Other mechanisms will be obvious to those of ordinary skill in the art having the benefit of this disclosure.

A user can push the push buttons 305 into the substantially vertical, lower leg 301 to telescope the substantially vertical, lower leg 301 into, and out of, the substantially vertical, upper leg 101. In one embodiment, when the push button 305 engages an uppermost aperture 306 of the plurality of leg extension apertures 110, the single-tube crutch 100 retracts into a collapsed position. By contrast, when the push button 305 engages a lowermost aperture 307 of the plurality of leg extension apertures 110, the single-tube crutch 100 extends to approximately fifty-two to fifty-three inches in length.

When adjustment of the substantially vertical, lower leg 301 relative to the substantially vertical, upper leg 101 is desired, the user depresses the push button 305 inwardly to release the substantially vertical, lower leg 301 relative to the substantially vertical, upper leg 101. The user then slides the substantially vertical, lower leg 301 to a desired position, which corresponds to one aperture of the plurality of leg extension apertures 110, and allows the push button 305 to protrude (or click) into a respective aperture of the plurality of leg extension apertures 110 to lock the substantially vertical, lower leg 301 relative to the substantially vertical, upper leg 101.

Figure 4:
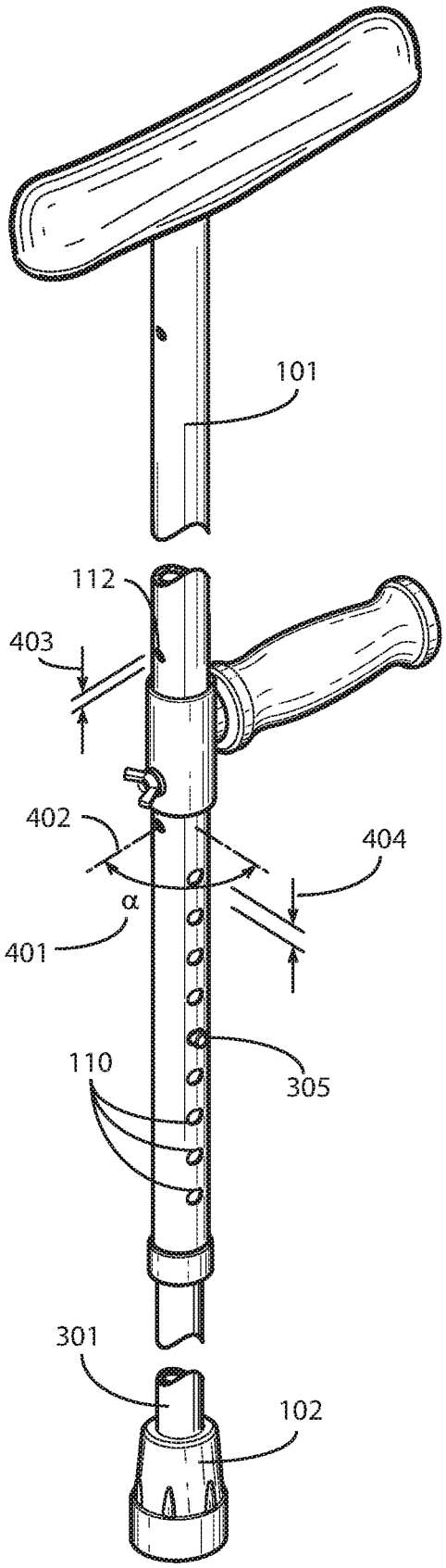
FIG. 4 illustrates another view of one explanatory crutch in accordance with one or more embodiments of the disclosure.

In one or more embodiments, the substantially vertical, upper leg 101 also includes a plurality of grip assembly apertures 112. As with the leg insertion apertures, while one set of grip assembly apertures is shown, for example, in FIG. 3, a second set is disposed on the opposite side of the upper leg, as can be seen by the line between screw 302 and wing nut 108. Turning briefly to FIG. 4, in this illustrative embodiment the plurality of grip assembly apertures 112 are offset 401 from the plurality of leg extension apertures 110 by an angle 402 of about ninety degrees. Additionally, to serve as a mnemonic device alerting a user to which aperture is which, in this illustrative embodiment each aperture of the plurality of grip assembly apertures 112 has a diameter 403 that is less than is the diameter 404 of each aperture of the plurality of leg extension apertures 110.

Turning now back to FIGS. 1-3, in one embodiment the annular receiver 107 of the grip assembly 105 includes an aperture 308. When adjustment of the grip assembly 105 along the substantially vertical, upper leg 101 is desired, the user translates the annular receiver 107 along the substantially vertical, upper leg 101 to a desired position, which corresponds to the aperture 308 of the annular receiver 107 aligning with one aperture of the plurality of grip assembly apertures 112. The user can then place the fastener, which is a screw 302 in this embodiment, through both the aperture 308 of the annular receiver 107 and the one aperture of the plurality of grip assembly apertures 112. A wing nut 108 or other complementary fastener can then be attached to the screw 302 to hold the grip assembly in the desired position.

In addition to the plurality of grip assembly apertures 112, in one embodiment the substantially vertical, upper leg 101 also includes a grip stowage aperture 309. As with the plurality of grip assembly apertures 112, in one embodiment the grip stowage aperture 309 offset (401) from the plurality of leg extension apertures 110 by an angle (402) of about ninety degrees. In this illustrative embodiment, the grip stowage aperture 309 is disposed on the substantially vertical, upper leg 101 on an opposite side of the plurality of grip assembly apertures 112 from the lower portion 111 of the substantially vertical, upper leg 101.

In one embodiment, the grip stowage aperture 309 is disposed more than twelve inches from an upper most aperture of the plurality of grip assembly apertures 112. In one embodiment, the grip stowage aperture 309 is disposed less than three inches from the underarm support 104.

The inclusion of a grip stowage aperture 309 is advantageous to the manufacturer because it provides a mechanism by which multiple crutches can be nested. Specifically, when shipping, packaging, or other storage of the single-tube crutch 100 is desired, the grip assembly 105 can be translated along the substantially vertical, upper leg 101 to a stowed position, which corresponds to the aperture 308 of the annular receiver 107 aligning with the grip stowage aperture 309. The fastener, which is a screw 302 in this embodiment, then passes through both the aperture 308 of the annular receiver 107 and the grip stowage aperture 309. A wing nut 108 or other complementary fastener can then be attached to the screw 302 to hold the grip assembly in the stowed position. The grip assembly 105 is shown in the stowed position in FIGS. 1 and 2, but is shown in the usage position in FIGS. 4 and 6. Usage of the single-tube crutch when the substantially vertical, lower leg 301 is fully inserted into the substantially vertical, upper leg 101, i.e., the collapsed position, with the grip assembly 105 in the stowed position, will be described in more detail with reference to FIGS. 6-8 below.

Turning again to FIG. 4, the substantially vertical, lower leg 301 is slidably adjustable within the substantially vertical, upper leg 101. In one or more embodiment, a frictional coupler can be disposed between the substantially vertical, lower leg 301 and the substantially vertical, upper leg 101 to provide a frictional force between the two. However, in other embodiments this component will be omitted. It should also be noted that the slip-resistant tip 102 can include, or can be replaced by, one or more metal prongs for use on ice or slippery surfaces.

As described above, in one or more embodiments the substantially vertical, lower leg 301 includes a push button 305 that can protrude through one aperture of the plurality of leg extension apertures 110. When adjustment of the overall length is desired, the user depresses the push button 305 inwardly to release the substantially vertical, lower leg 301 relative to the substantially vertical, upper leg 101. The user then slides the substantially vertical, lower leg 301 to a desired position, which corresponds to a respective one of the plurality of leg extension apertures 110, and allows the push button 305 to protrude into a respective aperture to lock the substantially vertical, lower leg 301 relative to the substantially vertical, upper leg 101.

Optionally, a spring member for shock reduction to provide comfort for the user can be placed between the substantially vertical, upper leg 101 and the substantially vertical, lower leg 301. Where included, the spring member absorbs at least some force resulting from contact occurring between the slip-resistant tip 102 and a supporting surface.

Figure 5:
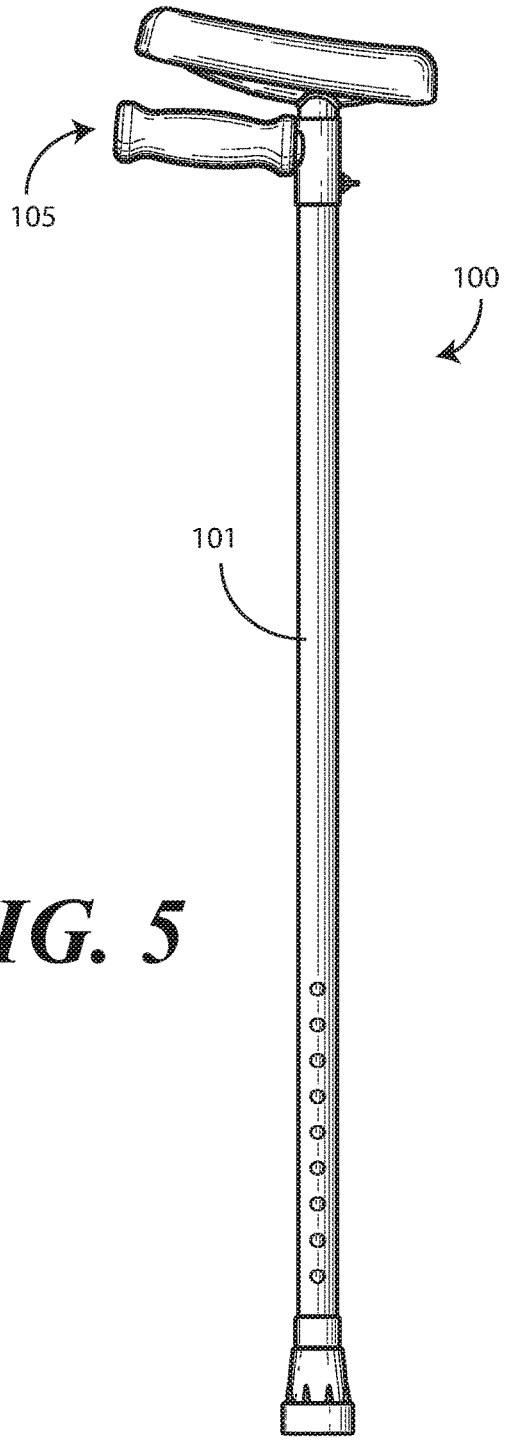
FIG. 5 illustrates one explanatory crutch in accordance with one or more embodiments of the disclosure in a collapsed configuration.

Turning now to FIG. 5, the single-tube crutch 100 is shown in the collapsed position. Specifically, the substantially vertical, lower leg (301) is fully inserted into the substantially vertical, upper leg 101, such that only the slip-resistant tip 102 is exposed. Additionally, the grip assembly 105 has been moved to the stowed position.

Figure 6:
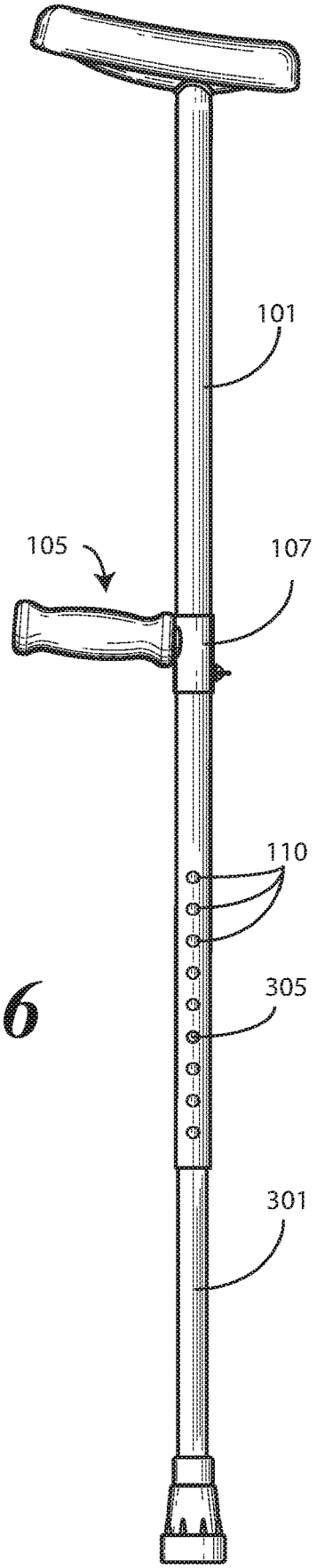
FIG. 6 illustrates one explanatory crutch in accordance with one or more embodiments of the disclosure in a functional configuration.

By contrast, turning now to FIG. 6, illustrated therein is the single-tube crutch 100 in the usage position. It should be noted that the term "substantially vertical," as it refers to the upper leg 101 and the lower leg 301, refers to the orientation of those components when in the usage position shown in FIG. 6. It should go without saying that "substantially vertical" does not preclude the single-tube crutch 100 from being pivoted such that its upper leg 101 and lower leg 301 define angles relative to the earth.

The substantially vertical, lower leg 301 has been telescopically extended to a desired position, which corresponds to a respective one of the plurality of leg extension apertures 110. This allows the push button 305 to protrude into a respective aperture to lock the substantially vertical, lower leg 301 relative to the substantially vertical, upper leg 101. Additionally, the grip assembly 105 has been translated downward such that the fastener engages the annular receiver 107 of the grip assembly 105 at a location where the aperture (308) of the annular receiver 107 aligns with an aperture of the plurality of grip assembly apertures 112.

Figure 7:
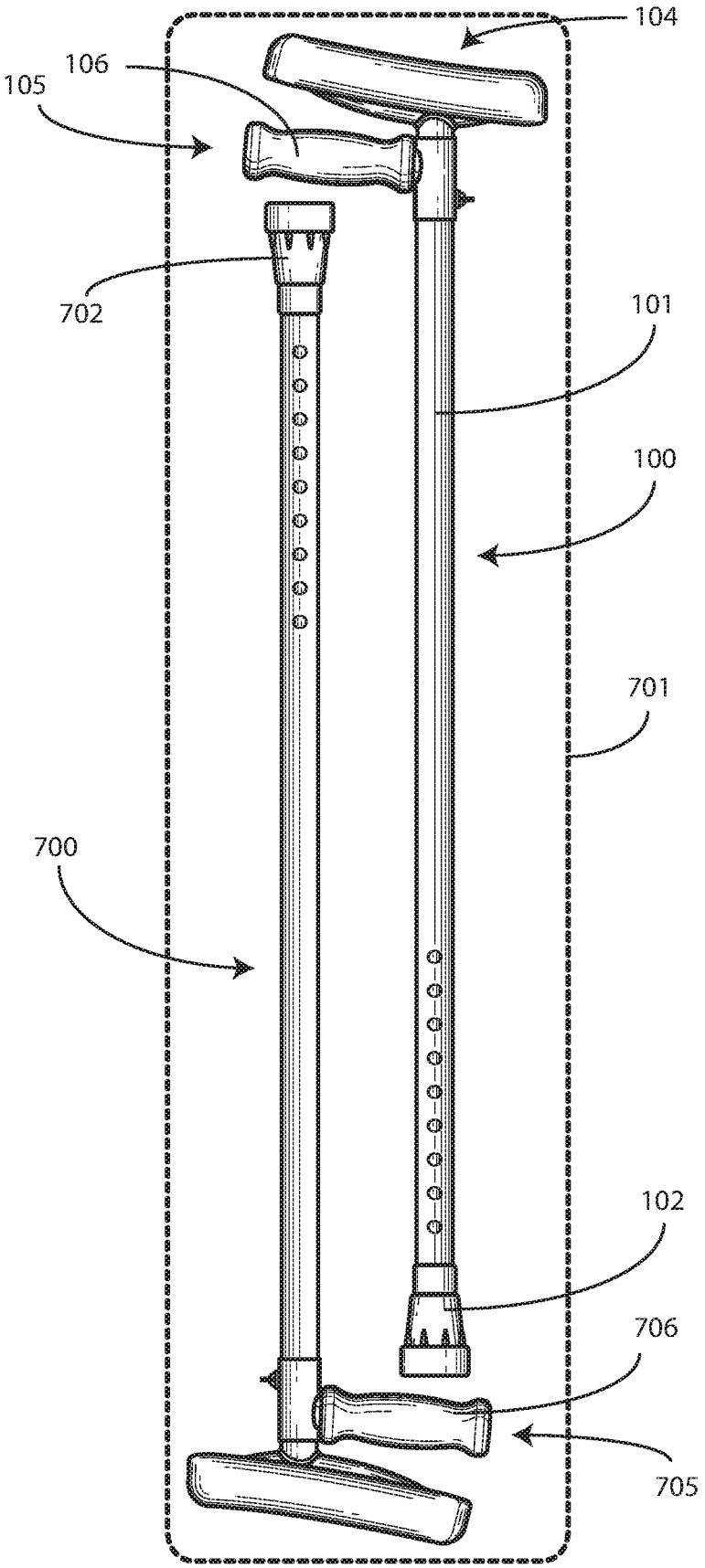
FIG. 7 illustrates two explanatory crutches in accordance with one or more embodiments of the disclosure in a nested configuration.

Turning now to FIG. 7, illustrated therein is one advantage offered by the fact that the grip assembly 105 can be translated along the substantially vertical, upper leg 101 to the stowed location adjacent to the underarm support 104. As shown in FIG. 7, a single-tube crutch 100 can another single-tube crutch 700 can be arranged in a nested configuration by rotating the other single-tube crutch 700 180-degrees out of phase relative to the single-tube crutch 100. This allows the slip-resistant tip 102 of the single-tube crutch 100 to abut the grip 706 of the other single tube crutch 700, and vice versa.

This nested configuration allows for an extremely compact packaging of the two single-tube crutches 100,700. For example, despite providing a crutch that is fifty-two or fifty-three inches in length when in the usage position, two crutches can be packaged in a nested configuration that is less than thirty-nine inches in length and eleven inches in width. This is incredibly small for full size crutches.

Figure 8:
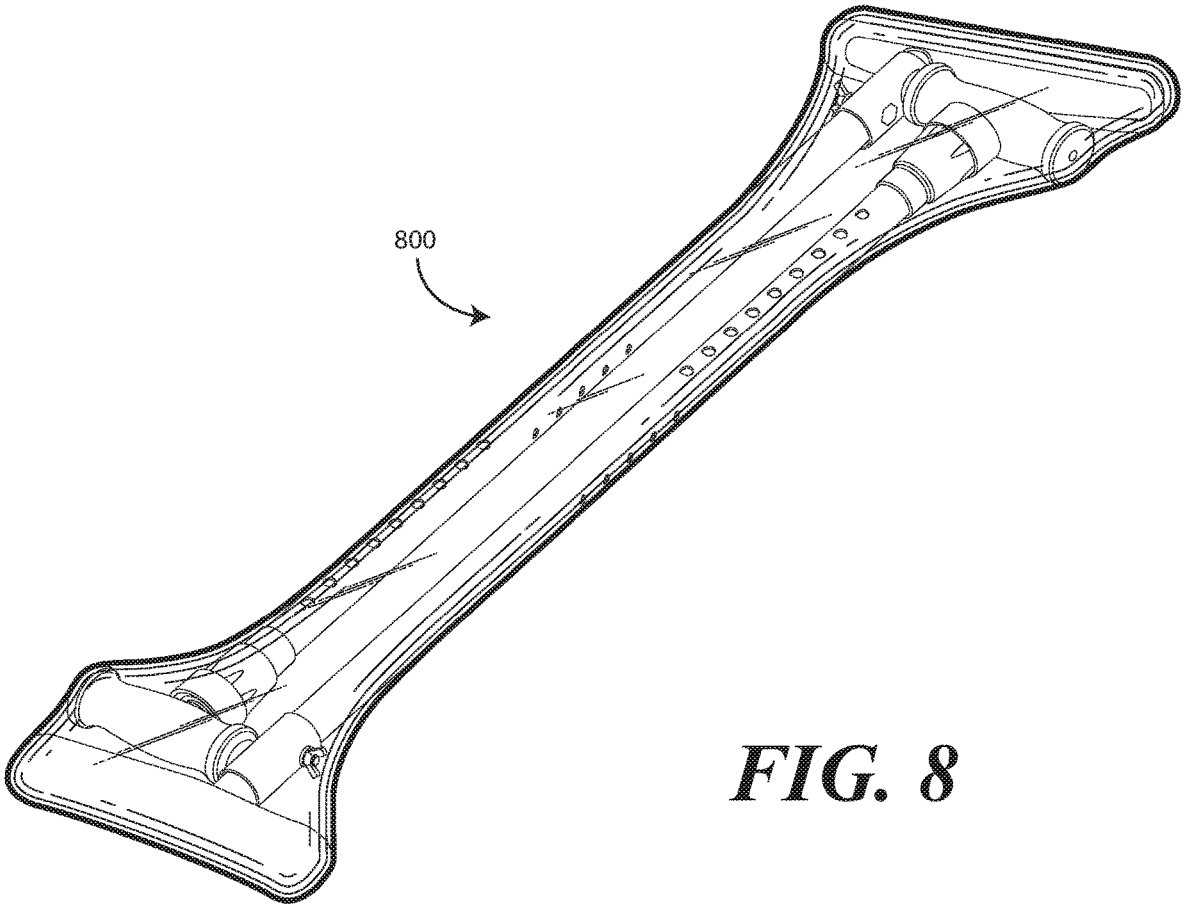
FIG. 8 illustrates two explanatory crutches in accordance with one or more embodiments of the disclosure in a packaged configuration.

As shown in FIG. 7, once the single-tube crutch 100 and the other single-tube crutch 700 are arranged in the nested configuration, packaging material 701 can be placed about the nested configuration. For example, plastic wrap can be used as the packaging material 701 and can be thermally sealed about the nested configuration. The plastic wrap can then be thermally shrunk about the single-tube crutch 100 and the other single-tube crutch 700. The resulting packaged crutch assembly 800, which is far smaller than prior art packages, is shown in FIG. 8.

Figure 9:
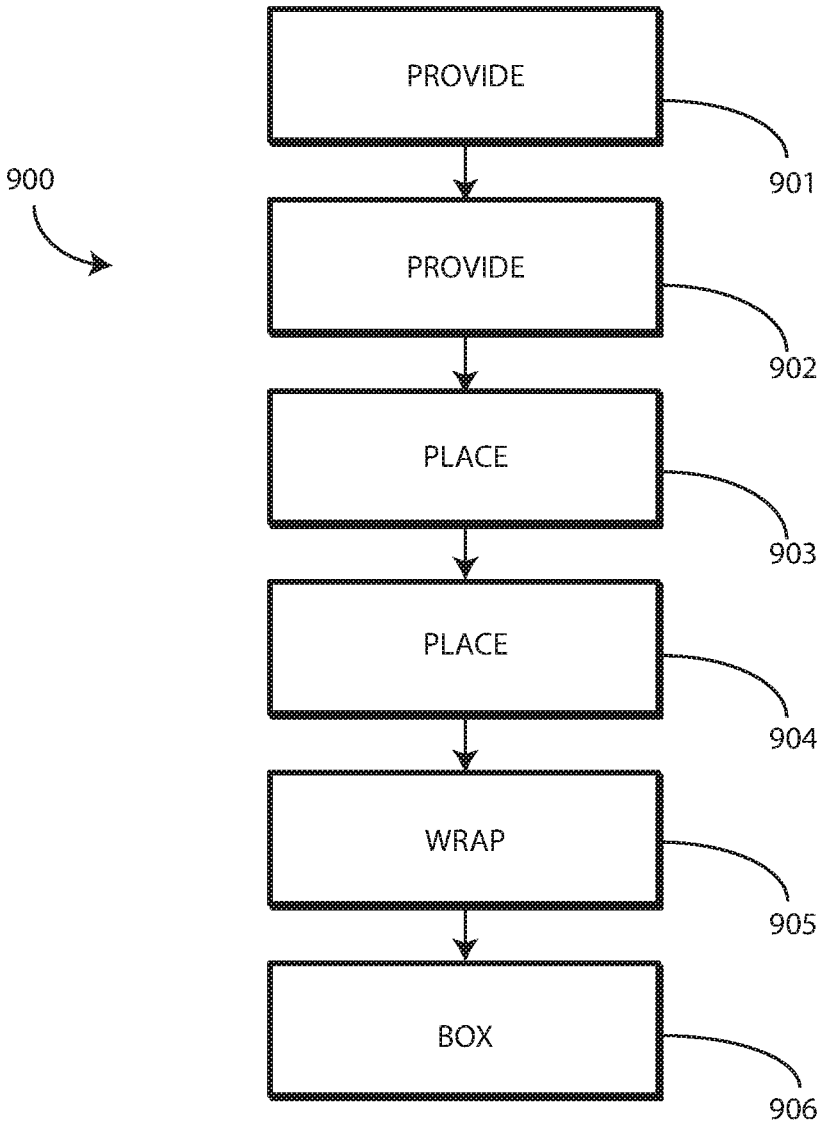
FIG. 9 illustrates one explanatory method in accordance with one or more embodiments of the disclosure.

Turning now to FIG. 9, illustrated therein is a method 900 of packaging two crutches in accordance with one or more embodiments of the disclosure. Beginning at step 901, the method 900 includes providing a single-tube crutch configured as described above. At step 902, the method 900 includes providing another single-tube crutch as described above.

At step 903, the method 900 includes placing the single-tube crutch and the other single-tube crutch in a nested configuration as shown in FIG. 7 above. At step 904, the method comprises placing the nested configuration in packaging material. At step 905, the method 900 comprises shrink-wrapping the packaging material of step 904 to obtain a packaged crutch assembly. At step 906, the packaged crutch assembly can be placed into a box for shipping. In one embodiment, the box has dimensions that are less than eleven by thirty-nine inches.

Figure 10:
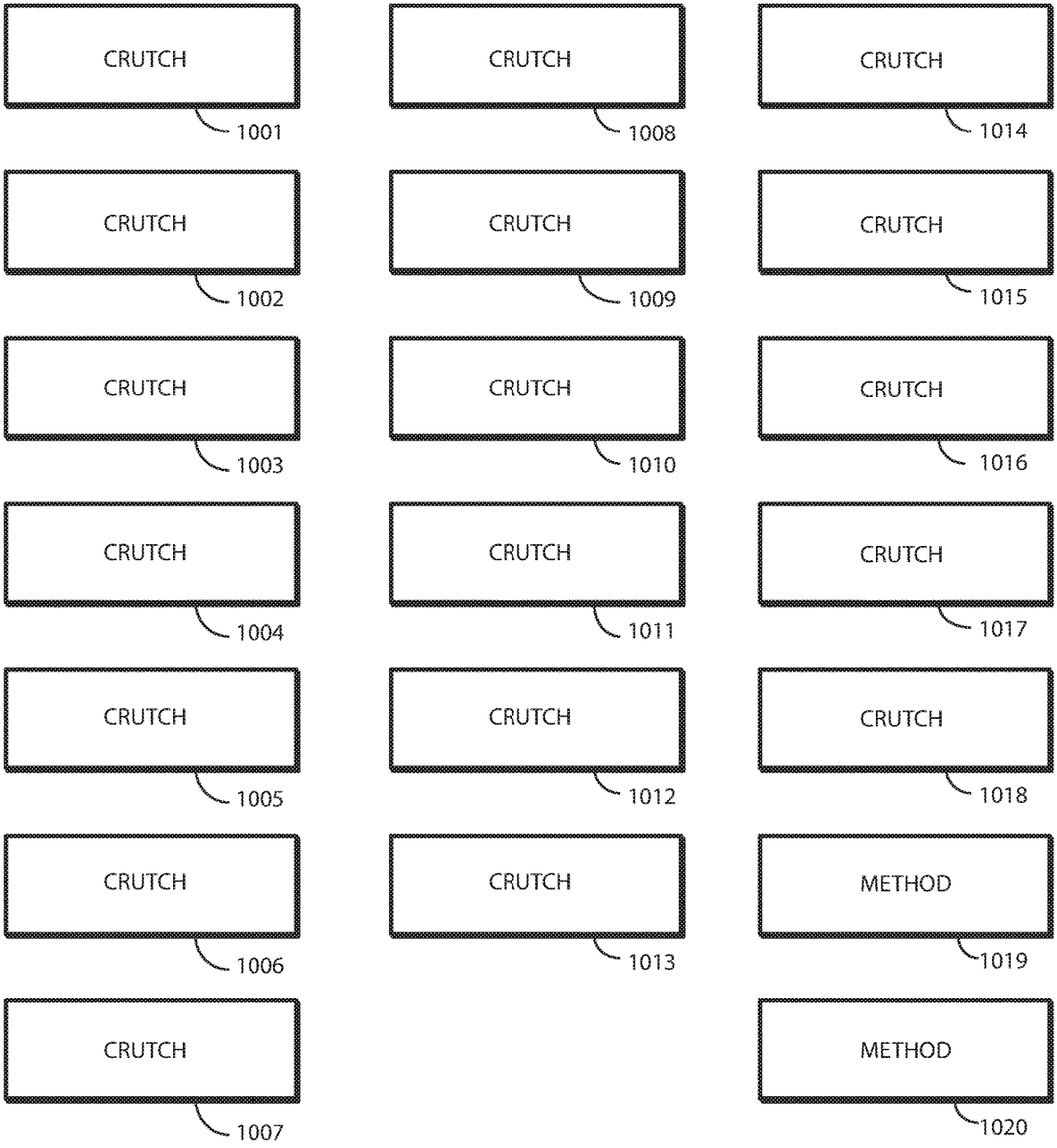
FIG. 10 illustrates various embodiments of the disclosure.

Turning now to FIG. 10, illustrated therein are various embodiments of the disclosure. At 1001, a crutch comprises a single tube support comprising an upper leg and a lower leg. In one embodiment, the lower leg of 1001 comprises a slip-resistant tip. In one embodiment, the lower leg of 1001 is fully insertable into a first end of the upper leg such that only the slip-resistant tip is exposed.

In one embodiment, the crutch of 1001 comprises an underarm support coupled to a second end of the upper leg opposite the first end. In one embodiment, the crutch of 1001 comprises a grip assembly configured to translate along the upper leg between a usage position and a stowed position.

In one embodiment, the crutch of 1001 comprises a plurality of grip assembly apertures disposed along the upper leg, each of which the grip assembly may align when in the usage position. In one embodiment, the crutch of 1001 comprises a stowage aperture disposed along the upper leg, with which the grip assembly may align when in the stowed position.

At 1002, the stowage aperture of 1001 is more than twelve inches from an upper most aperture of the plurality of grip assembly apertures. At 1003, the grip stowage aperture of 1002 is disposed less than three inches from the under arm support. At 1004, the crutch of 1003 further comprises a plurality of leg insertion apertures. At 1004, the plurality of grip assembly apertures are offset from the plurality of leg insertion apertures by an angle of about ninety degrees.

At 1005, the plurality of grip assembly apertures of 1004 comprises five apertures. At 1006, the plurality of leg insertion apertures comprises nine apertures. At 1007, the lower leg of 1004 comprises one or more push buttons that are spring biased outwardly from the lower leg. At 1008, the one or more push buttons of 1007 are operable to engage one or more apertures of the plurality of leg insertion apertures to protrude through the one or more apertures to lock the lower leg relative to the substantially vertical, upper leg. At 1009, the one or more push buttons of 1007 are operable to engage an uppermost aperture of the plurality of leg insertion when in a collapsed position where the lower leg is fully inserted into the upper leg.

At 1010, the crutch of 1009 is configured in the collapsed position. At 1010, another crutch is also configured in the collapsed position. At 1010, the crutch and the other crutch are in a nested configuration where the other crutch is rotated 180-degrees out of phase relative to the crutch. At 1011, packaging material is disposed about the nested configuration. At 1011, the packaging material has a length less than thirty-nine inches and a width less than eleven inches. At 1012, the packaging material of 1011 is shrink-wrapped about the nested configuration.

At 1013, the crutch of 1001 comprises an underarm support comprising an ergonomically curved tube contoured in a convex down configuration. At 1014, the grip assembly of 1001 comprises an annular receiver and a grip extending distally from the annular receiver. At 1015, the annular receiver of 1014 has an inner diameter greater than an outer diameter of the upper leg. At 1016, the annular receiver of 1015 defines an aperture. At 1016, the annular receiver of 1015 can optionally define two apertures disposed along an axis.

At 1017, the aperture(s) of 1016 align with at least one aperture of the plurality of grip assembly apertures when in the usage position. At 1018, the crutch of 1017 further comprises a fastener that is insertable through both the aperture of the annular receiver and at least one aperture of the plurality of grip assembly apertures.

At 1019, a method comprises providing a first crutch and a second crutch. In one embodiment, each crutch of 1019 comprises a single tube support comprising an upper leg and a lower leg that is fully insertable into the upper leg in a collapsed position such that only a slip-resistant tip is exposed.

At 1019, the crutch comprises an underarm support coupled to the upper leg. At 1019, a grip assembly configured to translate along the upper leg between a usage position and a stowed position. At 1019, a plurality of grip assembly apertures disposed along the upper leg, each of which the grip assembly may align when in the usage position. At 1019, a plurality of leg insertion apertures, a subset of which a push button of the lower leg may align to extend distally from the upper leg. At 1019, the plurality of leg insertion apertures is offset from the plurality of grip assembly apertures by an angle of about ninety degrees.

At 1019, the method includes placing the first crutch and the second crutch in the collapsed position. At 1019, the method also includes placing the grip assembly of the first crutch and the second crutch in the stowed position. At 1019, the method includes rotating the second crutch 180-degrees out of phase with the first crutch to form a nested configuration of the first crutch and the second crutch. At 1020, the method of 1019 comprises placing packaging material about the nested configuration and shrink-wrapping the packaging material.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A method, comprising:

providing a first crutch and a second crutch, each crutch comprising:

a single tube support comprising an upper leg and a lower leg that is fully insertable into the upper leg in a collapsed position such that only a slip-resistant tip is exposed;

an underarm support coupled to the upper leg;

a grip assembly configured to translate along the upper leg between a usage position and a stowed position;

a plurality of grip assembly apertures disposed along the upper leg, each of which the grip assembly may align when in the usage position; and a plurality of leg insertion apertures, a subset of which a push button of the lower leg may align to extend distally from the upper leg;

the plurality of leg insertion apertures offset from the plurality of grip assembly apertures by an angle of about ninety degrees;

placing the first crutch and the second crutch in the collapsed position;

placing the grip assembly of the first crutch and the second crutch in the stowed position; and rotating the second crutch 180-degrees out of phase with the first crutch to form a nested configuration of the first crutch and the second crutch.

2. The method of claim 1, further comprising placing packaging material about the nested configuration and shrink-wrapping the packaging material.

3. The method of claim 1, wherein the placing the first crutch and the second crutch in the collapsed position comprises engaging the push button with an uppermost aperture of the plurality of leg extension apertures.

4. The method of claim 1, wherein the placing the grip assembly of the first crutch and the second crutch in the stowed position comprises translating the grip assembly along the upper leg to the stowed position.

5. The method of claim 4, wherein the translating the grip assembly along the upper leg to the stowed position comprises translating an annular receiver of the grip assembly along the upper leg.

6. The method of claim 4, wherein the placing the grip assembly of the first crutch and the second crutch in the stowed position comprises aligning an aperture of an annular receiver of the grip assembly with a grip stowage aperture disposed along the upper leg.

7. The method of claim 6, further comprising inserting a screw through both the aperture of the annular receiver and the grip stowage aperture.

8. The method of claim 7, further comprising applying a wingnut or other complementary fastener to the screw to retain the grip assembly in the stowed position.

9. The method of claim 1, wherein placing the grip assembly of the first crutch and the second crutch in the stowed position comprises locating the grip assembly adjacent to the underarm support.

10. The method of claim 1, wherein the rotating the second crutch 180-degrees out of phase with the first crutch to form the nested configuration of the first crutch and the second crutch comprises causing the slip-resistant tip of the first crutch to abut the grip assembly of the second crutch.

11. The method of claim 10, wherein the rotating the second crutch 180-degrees out of phase with the first crutch to form the nested configuration of the first crutch and the second crutch comprises causing the slip-resistant tip of the second crutch to abut the grip assembly of the first crutch.

12. The method of claim 1, wherein rotating the second crutch 180-degrees out of phase with the first crutch to form the nested configuration of the first crutch and the second crutch results in the nested configuration having a length that is less than thirty-nine inches.

13. The method of claim 1, wherein the rotating the second crutch 180-degrees out of phase with the first crutch to form the nested configuration of the first crutch and the second crutch results in the nested configuration having a width of less than eleven inches.

14. The method of claim 1, further comprising placing packaging material about the nested configuration.

15. The method of claim 1, further comprising shrink-wrapping the nested configuration.

16. The method of claim 1, the providing the first crutch and the second crutch comprising manufacturing the upper leg and the lower leg from metal.

17. The method of claim 16, the providing the first crutch and the second crutch comprising manufacturing the upper leg and the lower leg from aluminum.

18. The method of claim 16, the providing the first crutch and the second crutch comprising manufacturing the upper leg and the lower leg from steel.

19. The method of claim 16, the providing the first crutch and the second crutch comprising manufacturing an annular receiver of the grip assembly from the same material as the upper leg and the lower leg.

20. The method of claim 1, further comprising placing the nested configuration in a box.

* * * * *